US006921279B2

(12) United States Patent
Sian et al.

(10) Patent No.: US 6,921,279 B2
(45) Date of Patent: Jul. 26, 2005

(54) ELECTRICAL CONNECTOR WITH CONNECTOR POSITION ASSURANCE MEMBER

(75) Inventors: Sucha Singh Sian, West Bloomfield, MI (US); Raymond Bruce McLauchlan, Macomb Township, MI (US)

(73) Assignee: FCI Americas Technology, Inc., Reno, NV (US)

( * ) Notice: Subject to any disclaimer, the term of this patent is extended or adjusted under 35 U.S.C. 154(b) by 84 days.

(21) Appl. No.: 10/456,646

(22) Filed: Jun. 5, 2003

(65) Prior Publication Data

US 2004/0248459 A1 Dec. 9, 2004

(51) Int. Cl.[7] ..... H01R 13/627

(52) U.S. Cl. ..... 439/352; 439/489

(58) Field of Search ..... 439/489, 595, 439/76.1, 350–358, 488

(56) References Cited

U.S. PATENT DOCUMENTS

| | | | | |
|---|---|---|---|---|
| 4,714,433 A | | 12/1987 | Rider, Jr. | 439/310 |
| 4,906,204 A | | 3/1990 | Metzger | 439/352 |
| 5,120,255 A | * | 6/1992 | Kouda et al. | 439/489 |
| 5,183,410 A | * | 2/1993 | Inaba et al. | 439/489 |
| 5,236,373 A | | 8/1993 | Kennedy | |
| 5,241,910 A | | 9/1993 | Cunningham et al. | |
| 5,257,944 A | | 11/1993 | Kennedy | |
| 5,275,575 A | | 1/1994 | Cahaly | 439/188 |
| 5,288,242 A | | 2/1994 | Muzslay | |
| 5,314,345 A | | 5/1994 | Cahaly et al. | |
| 5,605,471 A | * | 2/1997 | Plyler | 439/489 |
| 5,616,045 A | | 4/1997 | Gauker | |
| 5,681,178 A | | 10/1997 | Kunkle et al. | 439/352 |
| 5,685,743 A | | 11/1997 | Schmidt et al. | 439/701 |
| 5,688,141 A | | 11/1997 | Dullin | 439/352 |
| 5,775,930 A | * | 7/1998 | Model et al. | 439/352 |
| 5,827,083 A | | 10/1998 | Dullin | 439/188 |
| 5,863,214 A | | 1/1999 | Hanak | 439/352 |
| 5,895,282 A | | 4/1999 | Little | |
| 5,924,885 A | | 7/1999 | Pacher | 439/352 |
| 5,993,230 A | | 11/1999 | Gauker et al. | |
| 6,004,153 A | | 12/1999 | Myer et al. | 439/352 |
| 6,045,404 A | | 4/2000 | Myer | 439/595 |
| 6,109,955 A | | 8/2000 | Hanazaki et al. | 439/489 |
| 6,126,482 A | | 10/2000 | Stabile | |
| 6,149,448 A | | 11/2000 | Haller et al. | |
| 6,234,826 B1 | | 5/2001 | Wilber et al. | 439/352 |
| 6,250,952 B1 | | 6/2001 | Shiga et al. | |
| 6,261,115 B1 | | 7/2001 | Pederson et al. | 439/352 |

(Continued)

FOREIGN PATENT DOCUMENTS

| | | | |
|---|---|---|---|
| DE | 4317344 | A1 | 1/1994 |
| DE | 19617792 | A1 | 11/1997 |
| DE | 10032234 | A1 | 1/2002 |
| DE | 10151956 | A1 | 7/2002 |
| EP | 0112429 | A1 | 12/1982 |
| EP | 0591948 | B1 | 1/1997 |
| EP | 0591947 | B1 | 3/1997 |
| EP | 1124291 | A2 | 8/2001 |
| EP | 1130692 | A2 | 9/2001 |
| EP | 12007591 | A2 | 5/2002 |

*Primary Examiner*—J. F. Duverne
(74) *Attorney, Agent, or Firm*—Harrington & Smith, LLP

(57) ABSTRACT

An electrical connector including a housing having a deflectable latch; electrical contacts connected to the housing; and a connector position assurance (CPA) member slidably mounted to the housing. The latch has a front end with an inward projecting latch projection. The front end of the latch includes a first rearward facing stop surface and a second forward facing stop surface. The forward facing stop surface is located at a top side of the front end. The first stop surface is adapted to retain the CPA member at an unlocked position. The second stop surface is adapted to retain the CPA member at a locked position at the top side of the front end.

20 Claims, 5 Drawing Sheets

U.S. PATENT DOCUMENTS

| | | | | |
|---|---|---|---|---|
| 6,276,953 | B1 | 8/2001 | Gauker et al. | 439/352 |
| 6,290,539 | B1 | 9/2001 | Wilber et al. | 439/595 |
| 6,328,589 | B1 | 12/2001 | Annecke | |
| 6,354,860 | B1 | 3/2002 | Miller et al. | 439/352 |
| 6,361,348 | B1 | 3/2002 | Hall et al. | |
| 6,364,683 | B1 | 4/2002 | Kohno | 439/352 |
| 6,383,036 | B1 | 5/2002 | Steinhauser et al. | 439/752 |
| 6,406,319 | B2 | 6/2002 | Pederson et al. | 439/352 |
| 6,435,895 | B1 | 8/2002 | Fink et al. | 439/352 |
| 6,514,098 | B2 | 2/2003 | Marpoe, Jr. et al. | 439/352 |
| 6,530,785 | B1 | 3/2003 | Hwang | 439/76.1 |
| 2002/0111059 | A1 | 8/2002 | Raudenbush et al. | 439/352 |
| 2002/0115332 | A1 | 8/2002 | Myer et al. | 439/352 |
| 2003/0049962 | A1 | 3/2003 | Raudenbush et al. | 439/489 |

* cited by examiner

FIG. 1
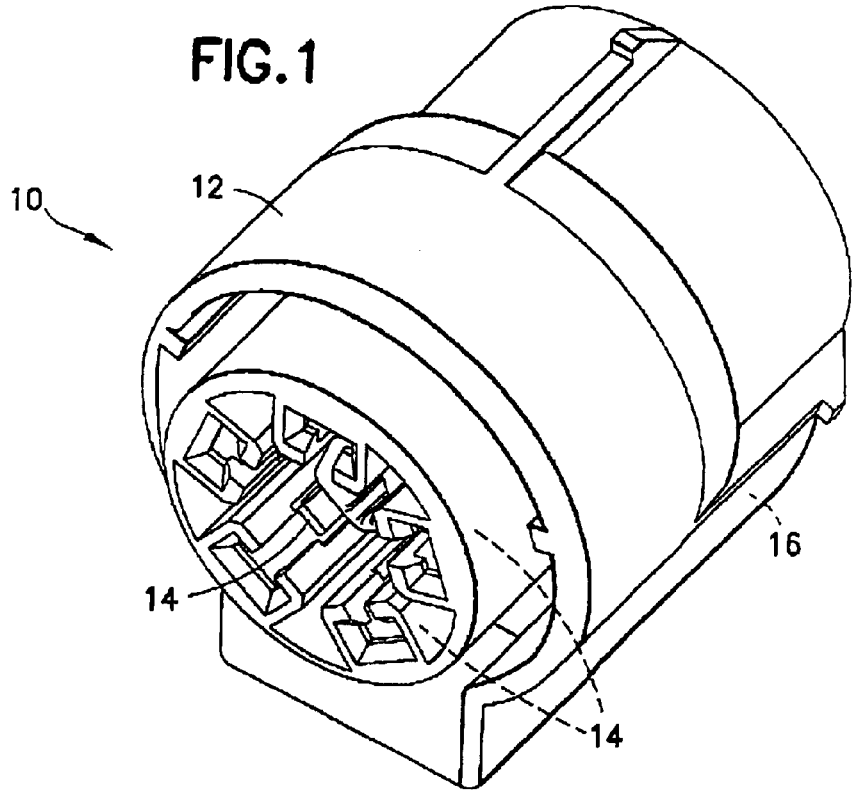
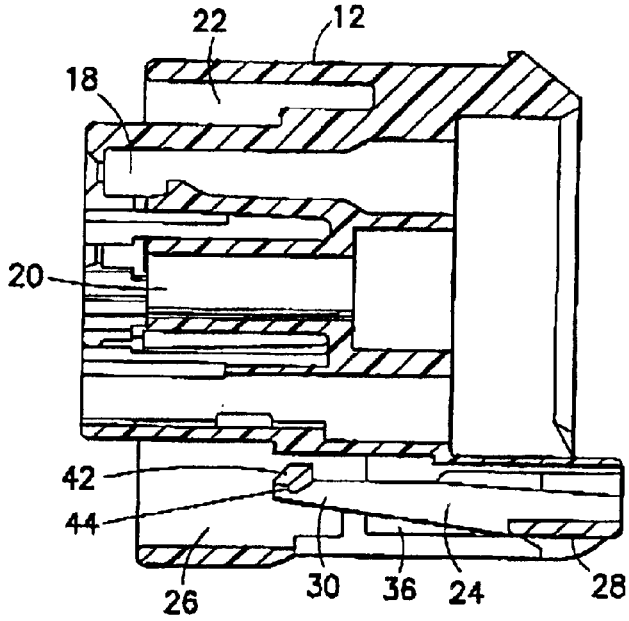
FIG. 2

ELECTRICAL CONNECTOR WITH CONNECTOR POSITION ASSURANCE MEMBER

BACKGROUND OF THE INVENTION

1. Field of the Invention

The present invention relates to electrical connectors and, more particularly, to a connector position assurance (CPA) system in an electrical connector.

2. Brief Description of Prior Developments

Electrical connectors having snap-lock latches and connector position assurance (CPA) members are generally well known in the art. One type of snap-lock latch uses a sleeve type connection locking design. This sleeve type connection locking design uses a window in the sleeve of a mating connector to attach to. A typical axial CPA for a locking ramp type design does not work for window type locking. Once the typical CPA is engaged after assembly with the mating connector, the primary latch is free to lift when depressed.

There is a need for a CPA connection system which can be used in a sleeve type connection locking design which helps to prevent the primary latch from opening once the CPA member is locked in an actuated position. There is also a need for an axial CPA connection system which has a stubbing feature to prevent the CPA member from being moved from an unlocked pre-assembly position, but which has the stubbing feature reduced once the electrical connector is attached to a mating connector.

SUMMARY OF THE INVENTION

In accordance with one aspect of the present invention, an electrical connector is provided including a housing having a deflectable latch; electrical contacts connected to the housing; and a connector position assurance (CPA) member slidably mounted to the housing. The latch has a front end with an inward projecting latch projection. The front end of the latch includes a first rearward facing stop surface and a second forward facing stop surface. The forward facing stop surface is located at a top side of the front end. The first stop surface is adapted to retain the CPA member at an unlocked position. The second stop surface is adapted to retain the CPA member at a locked position at the top side of the front end.

In accordance with another aspect of the present invention, an electrical connector is provided comprising a housing having a movable latch; electrical contacts connected to the housing; and a connector position assurance (CPA) member movably mounted to the housing. The latch has a leading end with an inwardly projecting latch projection. The latch and CPA member comprise means for retaining a portion of the CPA member against the latch in a top front pocket of the latch when the latch projection is in a fully locked position with a portion of a mating electrical connector.

In accordance with another aspect of the present invention, an electrical connector is provided comprising a housing having a movable latch, electrical contacts connected to the housing; and a connector position assurance (CPA) member slidably mounted to the housing. The CPA member comprises a forward cantilevered, deflectable arm with a front end having an inwardly projecting section. The latch has a forward cantilevered, deflectable arm with a front end having an inwardly projecting latch projection. The front end of the latch comprises a rearward facing surface comprising an inner latch surface and an outer ramp surface such that the inner latch surface retains the front end of the CPA member until the front end of the CPA member is moved up to the outer ramp surface, and such that the outer ramp surface cams the deflectable arm of the CPA member at least partially over the front end of the latch as the CPA member is moved forward along the latch.

BRIEF DESCRIPTION OF THE DRAWINGS

The foregoing aspects and other features of the present invention are explained in the following description, taken in connection with the accompanying drawings, wherein:

FIG. 1 is a perspective view of an electrical connector comprising features of the present invention;

FIG. 2 is a cross sectional view of the housing of the electrical connector shown in FIG. 1;

DETAILED DESCRIPTION OF THE PREFERRED EMBODIMENT

Figure 3:
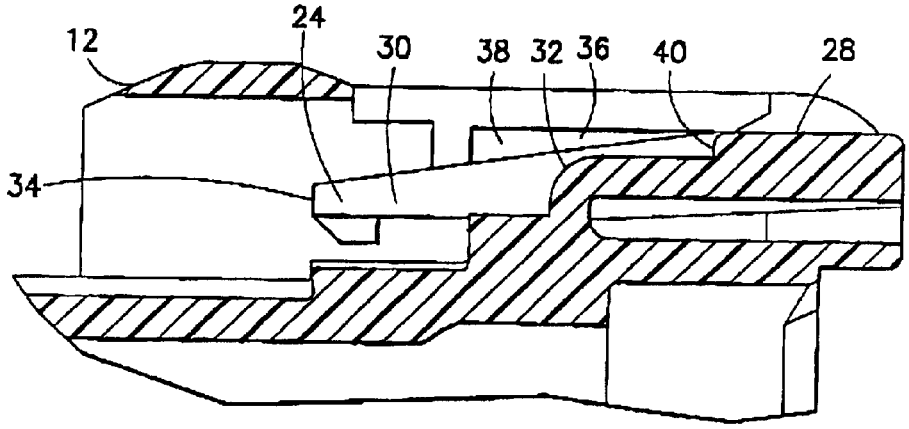
FIG. 3 is a partial enlarged cross sectional view of a latch of the housing shown in FIG. 2.

Referring to FIG. 1, there is shown a perspective view of an electrical connector 10 incorporating features of the present invention. Although the present invention will be described with reference to the exemplary embodiment shown in the drawings, it should be understood that the present invention can be embodied in many alternate forms of embodiments. In addition, any suitable size, shape or type of elements or materials could be used.

The electrical connector 10 generally comprises a housing 12, electrical contacts 14, and a connector position assurance (CPA) member 16. The CPA member and primary latch of the present invention are for a sleeve window type connection locking design. A typical axial CPA for a locking ramp type design does not work for window type locking. Once the typical CPA is engaged after assembly with the mating connector, the primary latch is free to lift when depressed. Hence, the CPA does not help in this situation. With the locking ramp type connector design of the present invention, the primary latch is supported and it cannot be released when the CPA is in its fully seated position.

The new design of the present invention provides the CPA member as being held behind the connector primary latch. With the present invention, upon assembly with a mating part, such as a sleeve with a window in a mating electrical connector housing, the CPA arm is lifted up and, it now can be pushed forward to its fully seated position. The CPA stays on top of the primary latch and, in this position, the latch cannot be released when the thumb pad is depressed.

With the exemplary embodiment of the present invention, the connector primary latch has two vertical levels. The first level holds the CPA in its pre-assembly position so that it cannot be pushed into its seated locked position accidentally before the mating connector is engaged. On the second level, the CPA is seated in its fully assembled position under some pressure and prevents the latch from lifting up to disassemble. The locked position of the CPA is controlled by the track length in the connector housing. The CPA is retained in its locked position in the primary latch. For servicing, the CPA can be pulled back to its pre-assembled position with a certain pre-determined force from its fully seated position.

The present invention also solves the problem of not being able to raise an axial CPA sufficiently in order to have it travel over the latch while still creating "stubbing" that restricts CPA movement when the mating connector has not been engaged. The present invention provides a method of CPA actuation for any geometric contour (i.e., circular, rectangular, pentagonal) that utilizes a latching method equipped with a "tooth" or drop down feature for the purpose of interlocking a connector system that employs a window or recess for a retention feature. An actuation ramp is added to the stubbing surface of the latch such that the lift which is needed can be provided and controlled through proper engineering practices. This actuation ramp allows the CPA to be moved over the stubbing section provided by the latch without excessive force.

Referring also to FIG. 2, the housing 12 is preferably a one-piece member comprised of dielectric material, such as molded plastic or polymer material. The housing 12 generally comprises contact receiving areas 18, an inner mating connector receiving area 20, an outer mating connector receiving area 22, and a deflectable latch 24. The housing 12 has a general round shape. However, in alternate embodiments, features of the present invention could be used with housings having any type of shape, such as square or rectangular for example.

The contact receiving areas 18 are adapted to receive the electrical contacts 14 therein. The electrical contacts 14 are adapted to removably connect to contacts in a mating electrical connector. In this embodiment, the electrical connector comprises five electrical contacts located in a general ring arrangement around the inner mating connector receiving area 20. In the embodiment shown, the electrical contacts 14 comprises female contacts adapted to receive male contacts of the mating electrical connector.

The outer mating connector receiving area 22 comprises a general ring shape located around the center portion of the housing which comprises the contact receiving areas 18. In this embodiment, the lower portion 26 of the outer mating connector receiving area 22 comprises an enlarged shape for receiving a sleeve 74 (see FIG. 8) of the mating electrical connector 72 having a latch section.

Referring also to FIG. 3, the housing 12 includes the deflectable latch 24. The deflectable latch 24 generally comprises a rear end finger contact section 28, a forward cantilevered deflectable arm 30, and a connecting section 32. The connecting section 32 connects the deflectable latch 24 to the rest of the housing 12. The connecting section 32 is resiliently deflectable to allow the finger contact section 28 to be moved inward and outward, and to allow the front end 34 of the arm 30 to be moved inward and outward. The exterior side of the finger contact section 28 is open to the exterior of the housing 12 such that a user can depress the finger contact section 28 inward. The connecting section 32 provides a natural biasing force to maintain the latch 24 in the home position as shown. This natural biasing force can be overcome by a user pressing the finger contact section 28 to move the front end 34 outward, or by a portion of the mating electrical connector wedging the front end 34 outward. In either case, the latch 24 effectively rocks or rotates at the connecting section 32.

The housing 12 also forms a CPA receiving area 36 for receiving the CPA member 16 in a location above the latch 24. The CPA receiving area 36 includes lateral slots 38 at lateral sides of the CPA receiving area. The front end of the finger contact section 28 also comprises a stop surface 40 which can function to limit the rearward movement of the CPA member 16 in a reward direction on the housing 12.

The latch 24 of the present invention provides a locking ramp type of connection with a drop down section or tooth and a thumb pad for moving the drop down section. The drop down section preferably comprises two vertical levels. One of the vertical levels is used as a stubbing hold for locating the CPA member in a pre-assembly position. The other vertical level is used to retain the CPA member in its fully seated and locked position.

Figure 4:
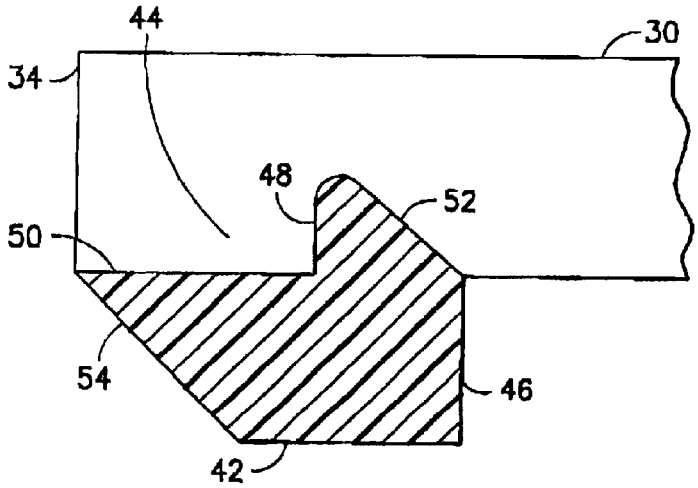
FIG. 4 is an enlarged partial cross sectional view of the front end of the deflectable latch shown in FIG. 3.

Referring to FIG. 4, the forward cantilevered deflectable arm 30 generally comprises the front end 34 which has an inward projecting latch projection 42 and a pocket 44. The pocket 44 is located at a front side and top, outer facing side of the front end 34. The front end 34 comprises a first rearward facing stop surface 46 and a second forward facing stop surface 48. The rearward facing stop surface 46 is part of the rearward facing surface of the front end 34. The rearward facing surface includes the stop surface 46 as an inner latch surface and an outer ramp surface 52.

The forward facing stop surface 48 is located at the top side of the front end 34 forming a rear side of the pocket 44. The pocket 44 has a bottom surface 50 which forms a bottom to the pocket 44. The bottom surface 50 is located above the inner bottom end of the latch projection 42. The forward facing surface of the front end 34 includes a ramp surface 54. The ramp surface 54 is used to cam the front end 34 outward, at least temporarily, when the electrical connector is being mated to the mating electrical connector. The first stop surface 46 is adapted to retain the CPA member 16 at an unlocked position, at least until the electrical connector is mated with the mating electrical connector. The second stop surface 48 is adapted to retain the CPA member 16 at a locked position at the top side of the front end 34 after the CPA member 16 has been moved to its locked position on the housing 12.

Figure 5:
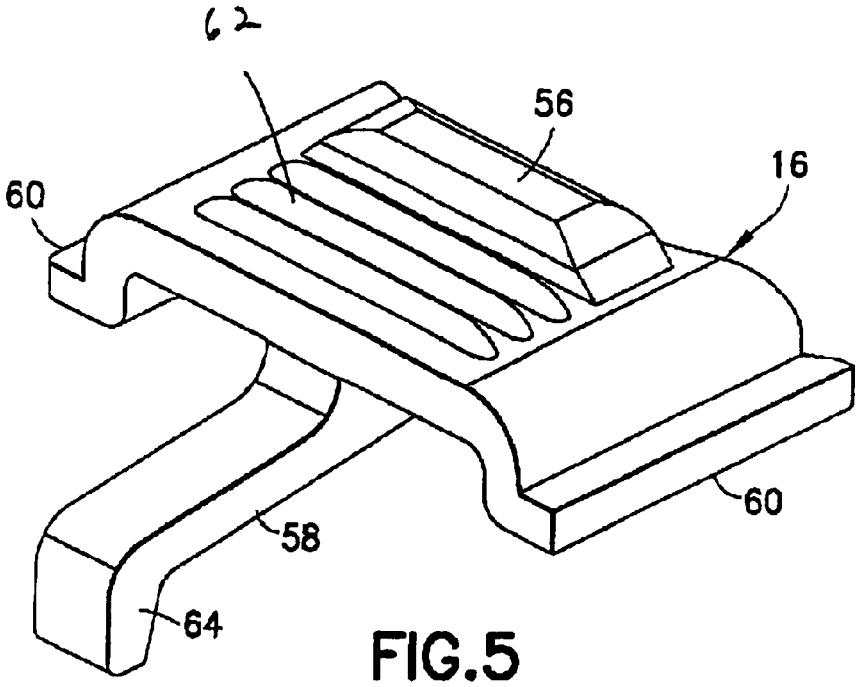
FIG. 5 is a perspective view of the CPA member of the electrical connector shown in FIG. 1.

Referring also to FIG. 5, a perspective view of the CPA member 16 is shown. The CPA member 16 is preferably a one-piece member comprised of molded plastic or polymer material. The CPA member 16 generally comprises a main body 56 and a forward cantilevered deflectable arm 58. The main body 56 includes lateral side tabs 60. The lateral side tabs 60 are located in the lateral slots 38 in the CPA receiving area 36 of the housing 12. The lateral side tabs 60 are adapted to slide forward and rearward in the lateral slots 38. Thus, the CPA member 16 is slidably attached to the housing 12. The CPA member 16 forms an axial CPA system. The main body 56 also comprises a finger contact section 62 on a top side thereof. The finger contact section 62 extends out of the CPA receiving area 36 at the exterior side of the housing 12. Thus, a user can contact the finger contact section 62 to slide the CPA member 16 forward and rearward on the housing 12.

Figure 6:
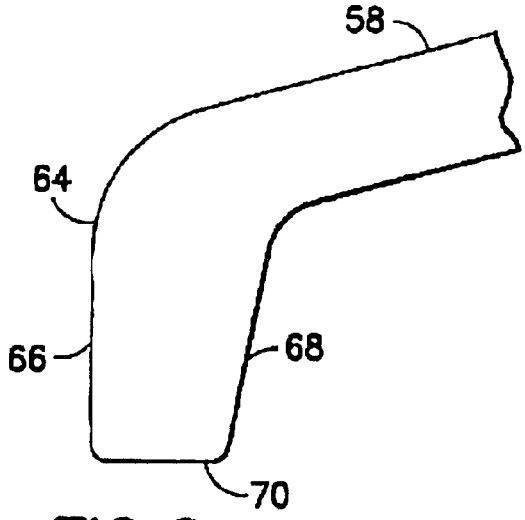
FIG. 6 is an enlarged view of the front end of the deflectable arm of the CPA member shown in FIG. 5.

The forward cantilevered deflectable arm 58 of the CPA member 16 extends in a general forward direction from the main body 56 in a general cantilevered fashion. The deflectable arm 58 is generally centrally located relative to the main body 56 and extends forward from the inner or bottom side of the main body. The deflectable arm 58 includes a front end 64. Referring also to FIG. 6, the front end 64 generally comprises a head with a front surface 66, a rear surface 68, and a bottom surface 70. The front end 64 extends in a general inward or downward direction.

Figure 7:
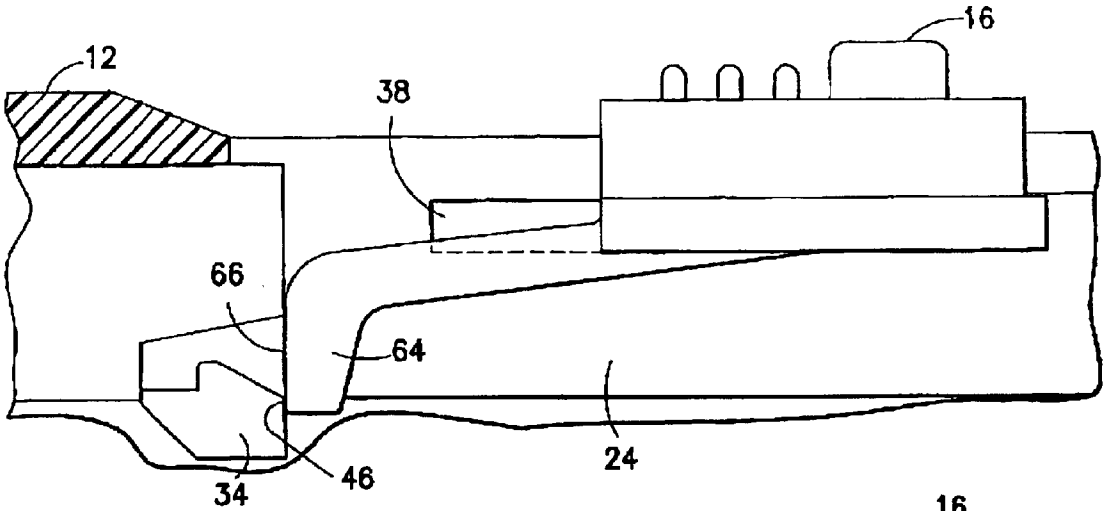
FIG. 7 is a partial cross sectional view of the latch shown in FIG. 3 and the connector position assurance (CPA) member shown in FIG. 5 shown in an unlocked position.

Referring also to FIG. 7, the CPA member 16 is shown attached to the housing 12, with a cutaway section of the housing, and the CPA member 16 being located in an unlocked rear position. FIG. 7 shows the electrical connector 10 before being mated with the mating electrical connector. In this position, the front 64 of the CPA member 16 is located behind the front end 34 of the deflectable latch 24. More specifically, the front surface 66 of the front end 64 is located behind the first rearward facing stop surface 46 of the front end 34. The stop surface 46, thus, functions as a limiter to prevent forward movement of the CPA member 16 on the housing 12 before the electrical connector 10 is connected to the mating electrical connector.

Figure 8:
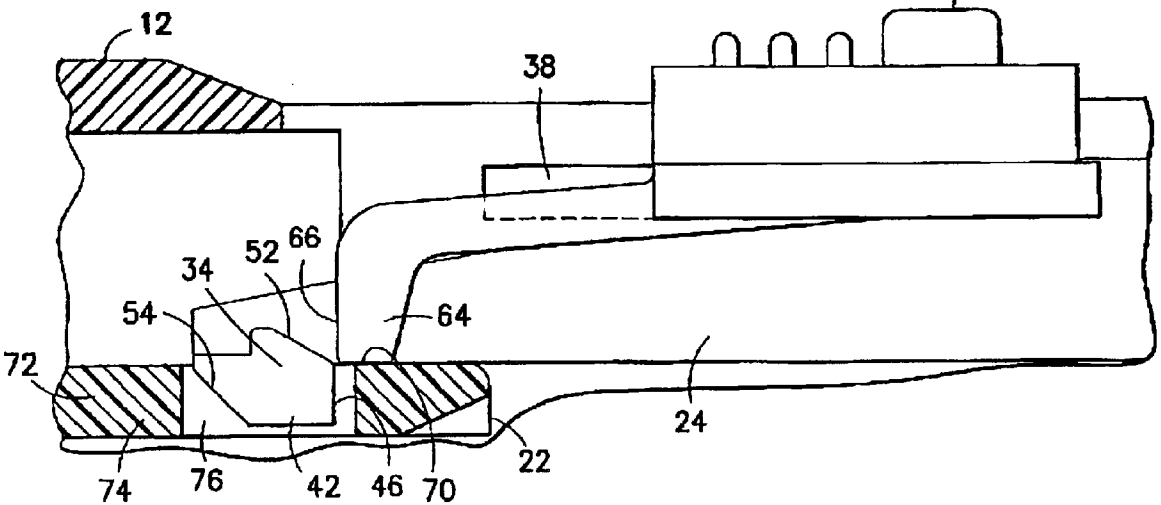
FIG. 8 is a partial cross sectional view of the latch and CPA member as shown in FIG. 7 shown attached to a portion of a mating electrical connector.

Referring now also to FIG. 8, the electrical connector 10 is shown connected to the mating electrical connector 72. More specifically, the mating electrical connector 72 comprises a portion 74, such as a circular outer sleeve, which is inserted into the outer mating connector receiving area 22. When the portion 74 is inserted into the outer receiving area 22, the leading edge of the portion 74 contacts the ramp surface 54 of the front end 34 and wedges the front end 34 in an outward direction. As the portion 74 is further inserted into the outer receiving area 22 the latch projection 42 of the front end 34 comes into registration with a window or aperture 76 of the portion 74. When the latch projection 42 comes into registration with the window 76, the deflectable latch 24 resiliently returns to its home position and snaps the latch projection 42 into the window 76. This effectively latches the housing 12 with the housing of the mating electrical connector 72.

As the leading end of the portion 74 pushes past the front end 34 of the deflectable latch 24, the leading end of the portion 74 comes into contact with the front end 64 of the CPA member 16. The portion 74 contacts the inner portion of the front surface 66 of the front end 64 and wedges the front end 64 in an outward direction. The bottom surface 70 of the front end 64 comes to rest on top of the outer surface of the portion 74. When the front end 34 of the deflectable latch 24 snaps into the window 76, the front surface 66 of the CPA member 16 is now located at the outer ramp surface 52 and above the first stop surface 46. Thus, the first stop surface 46 no longer provides a barrier to the forward movement of the front end 64.

One of the features of the present invention is the outer ramp surface 52. The surface provides an actuation ramp on the stubbing surface of the front end 34 which provides minimal lift and, thus, easier movement of the CPA member 16 from its unlocked position to its locked position. Without the outer ramp surface 52, movement of the front end 64 over a stubbing surface of the front end and into a pocket could require an excessive amount of force. This excessive force could damage the CPA member and/or the latch, or could be perceived by customers as being undesirable for their installers of the electrical connectors.

Figure 9:
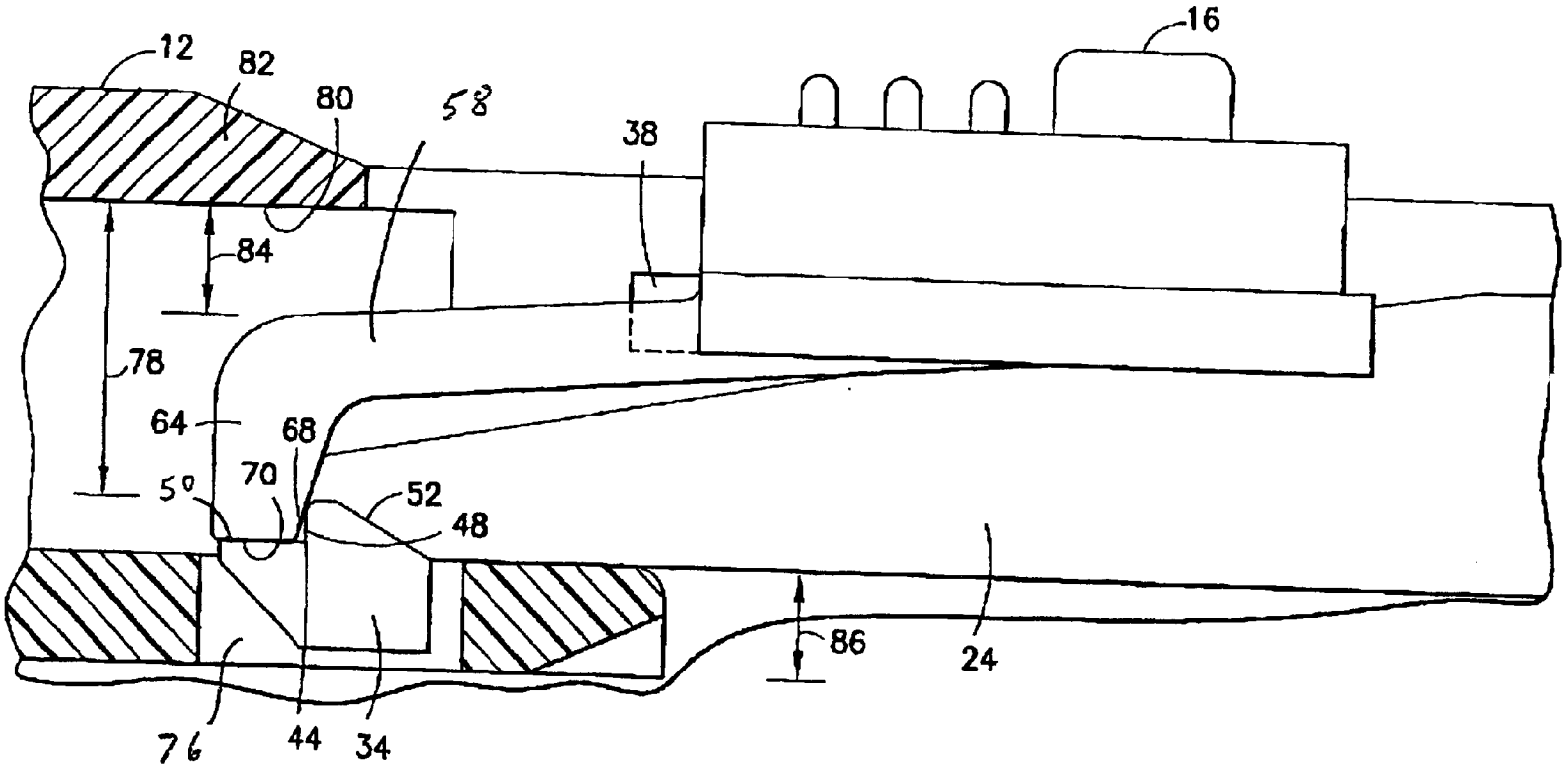
FIG. 9 is a partial cross sectional view of the latch and CPA member as shown in FIG. 8 with the CPA member moved to a locked position.

Referring also to FIG. 9, the CPA member 16 is shown moved from its rearward unlocked position to its forward locked position. As the CPA member 16 is moved from its position shown in FIG. 8 to its locked position is shown in FIG. 9, the bottom surface 70 of the front end 64 is cammed over the outer ramp surface 52 and resiliently snaps into the pocket 44 of the front end 34. A clearance height 78 is provided between the top of the outer ramp surface 52 and a bottom surface 80 of an outer portion 82 of the housing 12 which is sufficiently large enough to accommodate the height of the front end 64 of the CPA member 16. The outer portion 82 at the surface 80 is located directly above the front end 34 of the deflectable latch 24. The length of the lateral slots 38 limit the forward movement of the CPA member 16 relative to the housing 12. When the front end 64 snaps into the pocket 44, the rear surface 68 of the front end 64 is located against the second stop surface 48 at the pocket.

One of the primary purposes of the CPA member 16 is to indicate to the user that the electrical connector 10 is properly mated with the mating electrical connector 72. More specifically, a user can discern whether a proper mating connection has been made based upon whether or not the user can move the CPA member 16 from its rearward unlocked position to its forward locked position. If the user can move the CPA member 16 to its forward locked position, then the user knows that the two electrical connectors have been properly connected to each other. However, if the user cannot move the CPA member 16 to its forward locked position, then the user knows that the two electrical connectors have not been properly connected to each other.

When the portion 74 of the mating electrical connector's housing is inserted into the outer receiving area 22, the front end 34 of the latch 24 is moved outward towards the bottom surface 80 of the outer portion 82. This reduces the clearance height 78 between the outer tip of the outer ramp surface 52 and the bottom surface 80. If the two electrical connectors are not properly connected to each other, the latch projection 42 does not come into registration with the window 76. Thus, the height between the outer tip of the outer ramp surface 52 and the bottom surface 80 remains reduced. This reduced height is smaller than the height of the first end 64 of the CPA member 16.

When a user attempts to move the CPA member 16 forward, two features prevent the CPA member 16 from being moved into the window 44. First, the front end 64 of the CPA member 16 can be blocked by the first stop surface 46 of the front end 34. Second, even if the front end 64 is moved onto the outer ramp surface 52, when the front end 64 moves up the ramp surface 52 the top of the front end 64 contacts the bottom surface 80 before passing by the tip of the outer ramp surface 52. Thus, the reduced height between the surface 80 and the outer tip of the surface 52 is too small for the front end 64 to pass through. Since the user is unable to move the CPA member 16 to its forward locked position, the user automatically knows that the two electrical connectors 10 are not properly connected with each other. The user can then retry to connect the two electrical connectors to each other until a fully mated and proper electrical connection is made.

Interaction between the second stop surface 48 and the rear surface 68 helps to prevent the CPA member 16 from being unintentionally moved rearward again and disengaged from the front end 34 of the deflectable latch 24. In other words, the movable latch 24 helps to retain the CPA member 16 in its fully locked position. However, the front end 64 could be moved out of the pocket 44 in the event the electrical connector needs to be serviced. For example, a tool (not shown) could be used to deflect the front end 64 over the top of the front end 35. As another example, a sufficient predetermined force on the main body 56 could cause the slopped rear surface 68 of the front end 64 to be cammed upward and out of the pocket 44. With the front end 64 of the CPA member 16 located in the pocket 44 of the front end 34 of the deflectable latch 24, a clearance height 84 is provided between the top of the CPA member front end 64 at the bottom surface 80 of the housings outer portion 82. This clearance height 84 is about the same as the disengagement height 86 between the top side of the mating connectors housing portion 74 and the bottom side of the latch projection 42.

With the front end 64 of the CPA member 16 located in the pocket 44 of the front end 34 of the deflectable latch 24, the CPA member 16 exerts a biasing force against the front end 34 to bias the front end 34 in an inward direction. That is, the surface 70 of the front end 64 of the deflectable member 58 presses against surface 50 of the front end 34 of the latch 24, thereby urging the front end 34 into window 76 because of engagement of member 64 with on latch 24. Thus, unlike conventional CPA members which are only used to indicate whether or not proper electrical connection has been made between two electrical connectors, the CPA member 16 of the present invention also enhances the pullout force for the latch 24.

In alternate embodiments, any suitable number of electrical contacts could be provided. In addition, the contacts could be arranged in any suitable type of array. In alternate embodiments, the electrical contacts 14 could comprise any suitable type of contacts, such as the male electrical contacts for example. In another alternate embodiment, features of the present invention could be used in an type of electrical or optical connector, such as a flex circuit connector for example.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a housing having a deflectable latch, the latch having a front end with an inward projecting latch projection;

electrical contacts connected to the housing; and a connector position assurance (CPA) member slidably mounted to the housing, wherein the front end of the latch comprises a first rearward facing stop surface and a second forward facing stop surface, the forward facing stop surface being located at a top side of the front end, wherein the first stop surface is adapted to retain the CPA member at an unlocked position, and wherein the second stop surface is adapted to retain the CPA member at a locked position at the top side of the front end.

2. An electrical connector as in claim 1 wherein the first and second stop surfaces comprise substantially vertical surfaces.

3. An electrical connector as in claim 1 wherein the front end comprises a pocket into the top side, the pocket comprising the second stop surface.

4. An electrical connector as in claim 3 wherein the pocket comprises a bottom surface located above a bottom of the latch projection.

5. An electrical connector as in claim 1 wherein the housing comprises a section located above the latch projection and above the second stop surface which defines an area for receiving a head section of the CPA member.

6. An electrical connector as in claim 1 wherein the latch and CPA member comprise means for retaining a portion of the CPA member against the latch in a top front pocket of the latch when the latch projection is in a fully locked position with a portion of a mating electrical connector.

7. An electrical connector as in claim 1 wherein the CPA member comprising a forward cantilevered, deflectable arm with a front end having an inwardly projecting section, and wherein the front end of the latch comprises a rearward facing surface comprising an inner latch surface and an outer ramp surface such that the inner latch surface retains the front end of the CPA member until the front end of the CPA member is moved up to the outer ramp surface, and such that the outer ramp surface cams the deflectable arm of the CPA member at least partially over the front end of the latch as the CPA member is moved forward along the latch.

8. An electrical connector as in claim 7 wherein the first and second stop surfaces comprise substantially vertical surfaces, wherein the front end of the latch comprises a pocket with a bottom surface located above a bottom of the latch projection, and wherein the housing comprises a section located above the latch projection and above the second stop surface which defines a limited height area for receiving a head section of the CPA member.

9. An electrical connector assembly comprising:

a first electrical connector comprising the electrical connector as in claim 1; and a second mating electrical connector connected to the first electrical connector, the mating electrical connector comprising a portion with a latch window that is inserted into a receiving area of the housing of the first electrical connector, the latch projection extending into the latch window.

10. An electrical connector comprising:

a housing having a movable latch, the latch having a leading end with an inwardly projecting latch projection;

electrical contacts connected to the housing; and a connector position assurance (CPA) member movably mounted to the housing, wherein the latch and CPA member comprise means for retaining a portion of the CPA member against the latch in a top front pocket of the latch when the latch projection is in a fully locked position with a portion of a mating electrical connector.

11. An electrical connector as in claim 10 wherein the leading end of the latch comprises a first rearward facing stop surface and a second forward facing stop surface, the forward facing stop surface being located in the pocket at a top side of the leading end, wherein the first stop surface is adapted to retain the CPA member at an unlocked position, and wherein the second stop surface is adapted to retain the CPA at a locked position at the top side of the latch projection.

12. An electrical connector as in claim 10 wherein the first and second stop surfaces comprise substantially vertical surfaces.

13. An electrical connector as in claim 10 wherein the pocket comprises a bottom surface located above a bottom of the latch projection.

14. An electrical connector as in claim 10 wherein the housing comprises a section located above the latch projection and above the pocket which defines an area for receiving a head section of the CPA member.

15. An electrical connector as in claim 10 wherein the CPA member comprising a forward cantilevered, deflectable arm with a front end having an inwardly projecting section, and wherein the leading end of the latch comprises a rearward facing surface comprising an inner latch surface and an outer ramp surface such that the inner latch surface retains the front end of the CPA member until the front end of the CPA member is moved up to the outer ramp surface, and such that the outer ramp surface cams the deflectable arm of the CPA member at least partially over the leading end of the latch as the CPA member is moved forward along the latch.

16. An electrical connector as in claim 15 wherein the first and second stop surfaces comprise substantially vertical surfaces, wherein the pocket has a bottom surface located above a bottom of the latch projection, and wherein the housing comprises a section located above the latch projection and above the second stop surface which defines a limited height area for receiving a head section of the CPA member.

17. An electrical connector comprising:

a housing having a movable latch, the latch having a forward cantilevered, deflectable arm with a front end having an inwardly projecting latch projection;

electrical contacts connected to the housing; and a connector position assurance (CPA) member slidably mounted to the housing, the CPA member comprising a forward cantilevered, deflectable arm with a front end having an inwardly projecting section, wherein the front end of the latch comprises a rearward facing surface comprising an inner latch surface and an outer ramp surface such that the inner latch surface retains the front end of the CPA member until the front end of the CPA member is moved up to the outer ramp surface, and such that the outer ramp surface cams the deflectable arm of the CPA member at least partially over the front end of the latch as the CPA member is moved forward along the latch.

18. An electrical connector as in claim 17 wherein a top side of the front end of the latch comprises a pocket for receiving a portion of the CPA member therein.

19. An electrical connector as in claim 18 wherein the inner latch surface forms a first rearward facing stop surface and the pocket comprises a second forward facing stop surface, wherein the first stop surface is adapted to retain the CPA member at an unlocked position, and wherein the second stop surface is adapted to retain the CPA member at a locked position at the top of the latch projection.

20. An electrical connector as in claim 19 wherein the CPA member biases the movable latch towards a locked position when the CPA member is located in the pocket.

* * * * *